United States Patent [19]

Taguchi

[11] Patent Number: 4,881,267

[45] Date of Patent: Nov. 14, 1989

[54] ENCODER OF A MULTI-PULSE TYPE CAPABLE OF OPTIMIZING THE NUMBER OF EXCITATION PULSES AND QUANTIZATION LEVEL

[75] Inventor: Tetsu Taguchi, Tokyo, Japan

[73] Assignee: NEC Corporation, Tokyo, Japan

[21] Appl. No.: 194,372

[22] Filed: May 16, 1988

[30] Foreign Application Priority Data

May 14, 1987 [JP] Japan ..... 62-118475

[51] Int. Cl.[4] ..... G10L 5/00

[52] U.S. Cl. ..... 381/40; 381/51

[58] Field of Search ..... 381/40, 51-53

[56] References Cited

U.S. PATENT DOCUMENTS 4,709,390 11/1987 Atal et al. ..... 381/51

4,716,592 12/1987 Ozawa et al. ..... 381/40

*Primary Examiner*—Emanuel S. Kemeny

*Attorney, Agent, or Firm*—Sughrue, Mion, Zinn, Macpeak & Seas

[57] ABSTRACT

In a multipulse-excitation system, the number of pulses versus the number of quantization levels are adjusted as a function of speech signal power, for example, voiced sound is high power and needs only a few pulses, but large number of quantization levels, versus the reverse for unvoiced sound.

5 Claims, 4 Drawing Sheets

FIG. 4

| 1st THROUGH 3rd BITS | MAXIMUM AMPLITUDE | CODED VALUE |
|---|---|---|
| 0 0 0 | 8159 - 4063 | 0 |
| 0 0 1 | 4063 - 2015 | 1 |
| 0 1 0 | 2015 - 991 | 2 |
| 0 1 1 | 991 - 479 | 3 |
| 1 0 0 | 479 - 223 | 4 |
| 1 0 1 | 223 - 95 | 5 |
| 1 1 0 | 95 - 31 | 6 |
| 1 1 1 | 31 - 0 | 7 |

FIG. 5

| CLASS NUMBER | CODED VALUE | PULSE NUMBER | 1st BIT NUMBER | BIT NUMBER FOR THE AMPLITUDES | 2nd BIT NUMBER | BIT NUMBER FOR THE LOCATIONS | TOTAL BIT NUMBER |
|---|---|---|---|---|---|---|---|
| 1 | 0, 1 | 12 | 6 | 6 x 12 = 72 | 6 | 6 x 12 = 72 | 144 |
| 2 | 2, 3 | 16 | 4 | 4 x 16 = 64 | 5 | 5 x 16 = 80 | 144 |
| 3 | 4, 5 | 24 | 2 | 2 x 24 = 48 | 4 | 4 x 24 = 96 | 144 |
| 4 | 6, 7 | 36 | 1 | 1 x 36 = 36 | 3 | 3 x 36 = 108 | 144 |

ENCODER OF A MULTI-PULSE TYPE CAPABLE OF OPTIMIZING THE NUMBER OF EXCITATION PULSES AND QUANTIZATION LEVEL

BACKGROUND OF THE INVENTION

This invention relates to an encoder of a multi-pulse type for use in encoding a speech signal into a plurality of excitation pulses.

A conventional encoder of the type described is revealed in U.S. application Ser. No. 153,290 filed Feb. 4, 1988, by Taguchi, namely, the instant applicant and assigned to the instant assignee. The encoder is used in general in combination with a decoder which is used as a counterpart of the encoder.

In the conventional encoder, the speech signal is divided into a sequence of frames. The speech signal is encoded into a plurality of excitation pulses for each frame by the use of a pulse search method known in the art. Each of the excitation pulses has an amplitude and a location determined by the speech signal. The encoder comprises a quantizer having a predetermined number of quantization levels and quantizes the excitation pulses into a quantized pulse signal. The encoder transmits the quantized pulse signal to the decoder through a transmission medium. If circumstances require, the quantized pulse signal is once memorized in a memory and then supplied to the decoder.

The decoder decodes the quantized pulse signal into a decoded signal and produces the decoded signal as a synthetic speech signal. Quality of the synthetic speech signal is influenced in general by the number of the excitation pulses and the number of the quantization levels or steps.

Generally speaking, when the speech signal represents voiced sound to have high electric power, the speech signal can be characterized by a small number of excitation pulses. The decoder can therefore produce a favorable synthetic speech signal regardless of the number of the excitation pulses. The decoder is, however, influenced by quantization noise. The encoder therefore must quantize the excitation pulses with a large number of quantization levels.

On the other hand, when the speech signal represents unvoiced sound to have low electric power, the speech signal must be characterized by a large number of excitation pulses. The decoder therefore requires the large number of excitation pulses in order to derive the favorable synthetic speech signal. The decoder is, however, not influenced by the quantization noise. The encoder therefore may quantizes the excitation pulses with a small number of quantization levels. The conventional encoder is, however, constant in number of the excitation pulses and the quantization levels regardless of the electric power. The decoder used as a counterpart of the conventional encoder is therefore restricted in quality of the synthetic speech signal.

SUMMARY OF THE INVENTION

It is therefore an object of this invention to provide an encoder which is capable of optimizing the number of the excitation pulses and the quantization levels in accordance with electric power of the speech signal.

It is another object of this invention to provide an encoder which is suitable for a counterpart decoder capable of producing a synthetic speech signal with a high quality.

An encoding device to which this invention is applicable is for use in encoding a speech signal into an encoded signal. The encoder includes pulse producing means responsive to the speech signal for producing an excitation pulse sequence including a predetermined number of excitation pulses in each of the frames.

According to an aspect of this invention, the encoding device comprises detecting means responsive to the speech signal for detecting electric power of the speech signal to produce a detection signal representative of the electric power by one of a plurality of levels for each of the frames, and processing means coupled to the pulse producing means and the detecting means for processing the excitation pulse sequence in accordance with the detection signal to produce a processed signal as the encoded signal.

According to another aspect of this invention, the encoding device comprises detecting means responsive to the excitation pulse sequence for detecting electric power of the excitation pulse sequence to produce a detection signal representative of the electric power by one of a plurality of levels for each of the frames, and processing means coupled to the pulse producing means and the detecting means for processing the excitation pulse sequence in accordance with the detection signal to produce a processed signal as the encoded signal.

BRIEF DESCRIPTION OF THE DRAWING

FIG. 4 is a view for use in describing an operation of a maximum amplitude quantizer included in the encoder illustrated in FIG. 2; and FIG. 5 is a view for use in describing an operation of a processing unit included in the encoder illustrated in FIG. 2.

DESCRIPTION OF THE PREFERRED EMBODIMENT

Figure 1:
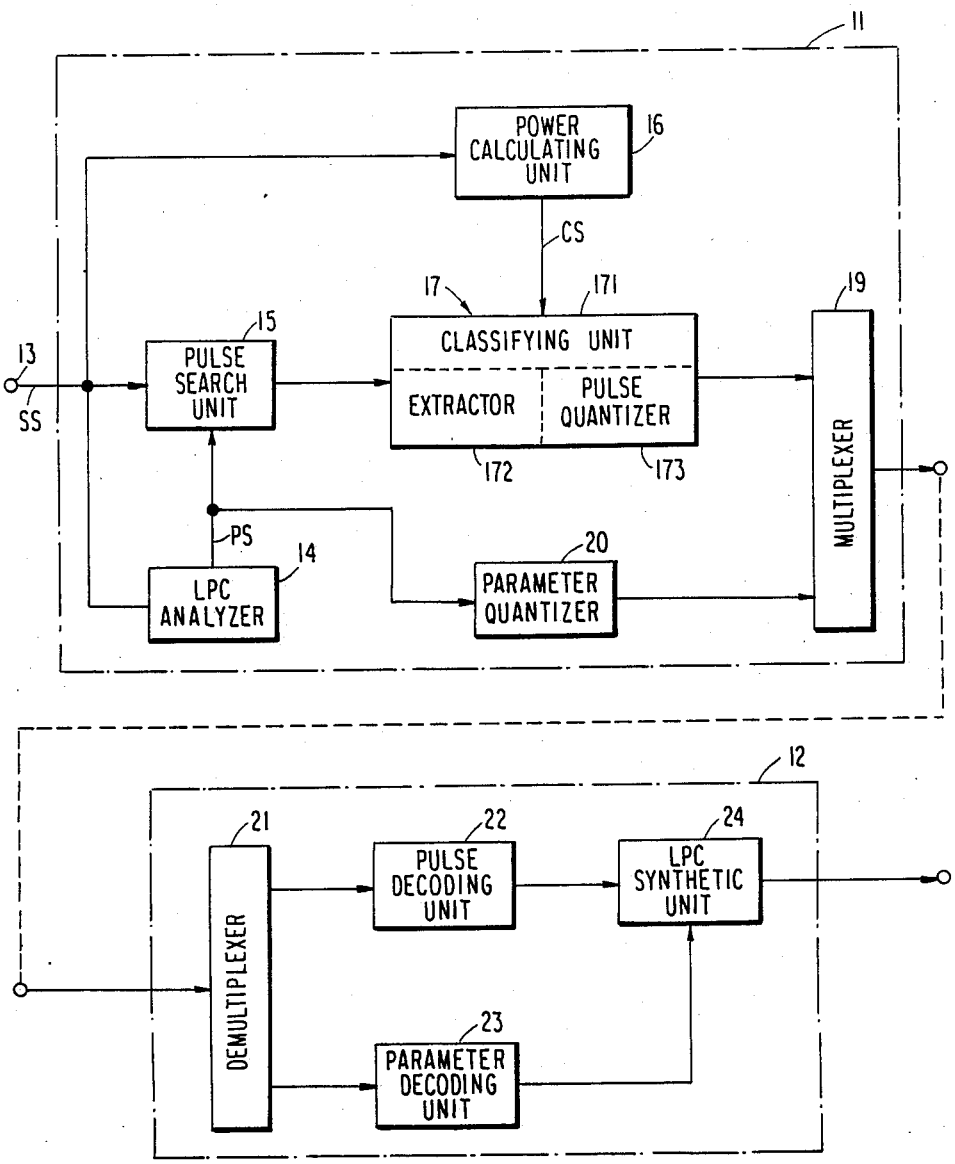
FIG. 1 is a block diagram of an encoder according to a first embodiment of this invention and a decoder for use as a counterpart of the encoder.

Referring to FIG. 1, a multi-pulse type encoder 11 according to a first embodiment of this invention is used in combination with a decoder 12 which is used as a counterpart of the encoder 11.

A speech signal SS is supplied to the encoder 11 through an encoder input terminal 13. The speech signal SS is divided into a succession of speech signal frames by the use of a processing circuit such as an analog-to-digital converter which will later be illustrated. Each speech signal frame lasts for a time interval of, for example, 20 milliseconds and includes N samples of the speech signal SS. The number N is determined by a sampling frequency. Description will be directed to only one speech signal frame of the speech signal SS merely for brevity of the description.

The encoder 11 comprises an LPC (Linear Predictive Coding) analyzer 14 and a pulse search unit 15. The speech signal frame has a spectrum envelope. Supplied with the speech signal frame, the LPC analyzer 14 carries out an LPC analysis and calculates LPC parameters, such as k parameters, in the manner known in the art. The LPC parameters specify the spectrum envelope. The LPC analyzer 14 delivers a parameter signal PS to the pulse search unit 15. Supplied with the speech signal frame and the parameter signal PS, the pulse search unit 15 carries out a pulse search operation in the manner which will later be described in detail. The pulse search unit 15 produces a plurality of excitation pulses one by one as an excitation pulse group. The pulse search unit 15 may therefore be called a pulse producing unit. The number of the excitation pulses has a maximum value which is necessary for the encoder 12. Each of the excitation pulses has an amplitude and a location and are generated one after another from the excitation pulse of a large amplitude to that of a small amplitude.

The encoder 11 further comprises a power calculating unit 16. The speech signal frame has electric power which depends on the amplitudes of the respective samples. The power calculating unit 16 calculates the electric power by carrying out a predetermined calculation known in the art. The predetermined calculation is, for example, to calculate a sum of squares of the amplitudes of the N samples. The power calculating unit 16 is therefore called a power detecting unit. The power calculating unit 16 delivers a calculation result signal CS representative of an electric power level to a processing unit 17. The processing unit 17 comprises a classifying unit 171, an extractor 172, and a pulse quantizer 173. In accordance with the electric power level, the processing unit 17 optimizes the number of the excitation pulses for transmission to the decoder 12 and bit numbers for use in quantizing the amplitudes and the locations of the excitation pulses by the pulse quantizer 173. This is based on the reason mentioned in the preamble of the instant specification.

For this purpose, the classifying unit 171 classifies the electric power level in one of a plurality of classes. The extractor 172 extracts a set of the excitation pulses from the excitation pulse group in accordance with one of the classes of the electric power level and produces the set of the excitation pulses as extracted pulses. As will later be described in detail, the pulse number of the extracted pulses is determined with reference to the classes of the electric power level discretely in inverse proportion to the electric power level.

The pulse quantizer 173 quantizes the amplitudes and the locations of the extracted pulses into a set of quantized amplitudes and a set of quantized locations. Each of the quantization amplitudes is represented by binary bits of a first bit number. Each quantized location is represented by binary bits of a second bit number. The pulse quantizer 173 produces the quantized amplitudes and the quantized locations as a quantized pulse signal. As will later be described in detail, the first and the second bit numbers are determined with reference to the classes of the electric power level discretely in proportion to the electric power level with a product of the pulse number and a sum of the first and the second bit numbers kept at a predetermined number. As a result, the pulse number has classes equal to the classes of the electric power level. Similarly, each of the first and the second bit numbers also has classes equal to the classes of the electric power level.

To be more exact, when the speech signal frame has a high electric power level, the extracted excitation pulses are of a small number while the first and the second bit numbers are large. On the contrary, when the speech signal frame has a low electric power level, the extracted excitation pulses are of a large number while the first and the second bit numbers are small. In other words, the pulse quantizer 173 has a large and a small number of quantization levels when the electric power level is high and low or strong and weak, respectively. The processing unit 17 delivers the quantized pulse signal to a multiplexer 19. The quantized pulse signal may be called an encoded signal or a processed signal.

In the meanwhile, the parameter signal PS is supplied to a parameter quantizer 20. The parameter quantizer 20 quantizes the parameter signal PS and delivers a quantized parameter signal to the multiplexer 19. The multiplexer 19 multiplexes the quantized pulse signal and the quantized parameter signal into a multiplexed signal. The multiplexed signal is transmitted through a transmitter (not shown) to the decoder 12 through a transmission medium depicted by a dashed line.

In FIG. 1, the decoder 12 comprises a demultiplexer 21, a pulse decoding unit 22, a parameter decoding unit 23, and an LPC synthetic unit 24 comprising an all-pole type digital filter. Supplied with the multiplexed signal through the transmission medium, the demultiplexer 21 demultiplexes the multiplexed signal into a demultiplexed pulse signal and a demultiplexed parameter signal. The demultiplexed pulse signal is decoded by the pulse decoding unit 22 into a decoded pulse signal. The decoded pulse signal is supplied as reproduced excitation pulses to the LPC synthetic unit 24. On the other hand, the demultiplexed parameter signal is decoded by the parameter decoding unit 23 into a decoded parameter signal. The decoded parameter signal is also supplied as reproduced LPC parameters to the LPC synthetic unit 24. The LPC synthetic unit 24 synthesizes the reproduced excitation pulses and the reproduced LPC parameters in the manner known in the art and produces a synthetic speech signal.

Figure 2:
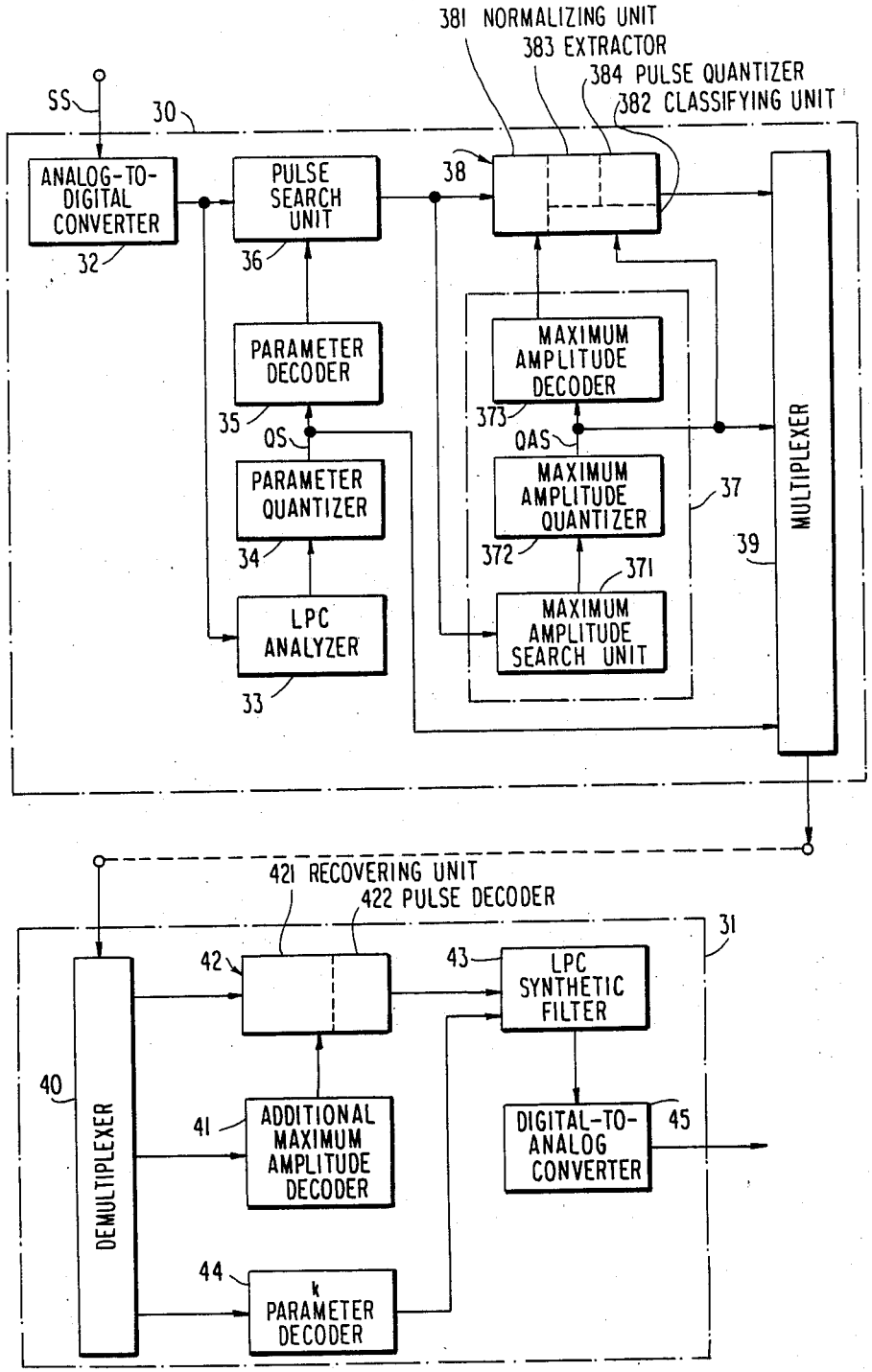
FIG. 2 is a block diagram of an encoder according to a second embodiment of this invention and a decoder for use as a counterpart of the encoder.

Referring to FIG. 2, a multi-pulse type encoder 30 is used as a second embodiment of this invention in combination with a decoder 31 which is used as a counterpart of the encoder 30.

In order to divide the speech signal SS into a succession of speech signal frames, the encoder 30 comprises an analog-to-digital converter 32 comprising a sampler, a quantizer, and a low-pass filter, all of which are known in the art and are not shown in FIG. 2. The analog-to-digital converter 32 produces a succession of speech signal frames, each of which consists of N quantized samples in the manner known in the art. Supplied with the speech signal frame, an LPC analyzer 33 carries out the LPC analysis and calculates k parameters in the manner known in the art. The LPC analyzer 33 delivers a k parameter signal to a parameter quantizer 34. The k parameter signal comprises first through n-th k parameters $k_l$ to $k_n$ in each speech signal frame. The parameter quantizer 34 quantizes the k parameter signal and sends a quantized k parameter signal QS to a parameter decoder 35. The quantized k parameter signal QS is decoded by the parameter decoder 35 into a decoded k parameter signal. A pulse search unit 36 is supplied with the speech signal frame and the decoded k parameter signal and carries out a pulse search operation to produce a plurality of excitation pulses as an excitation pulse group.

Figure 3:
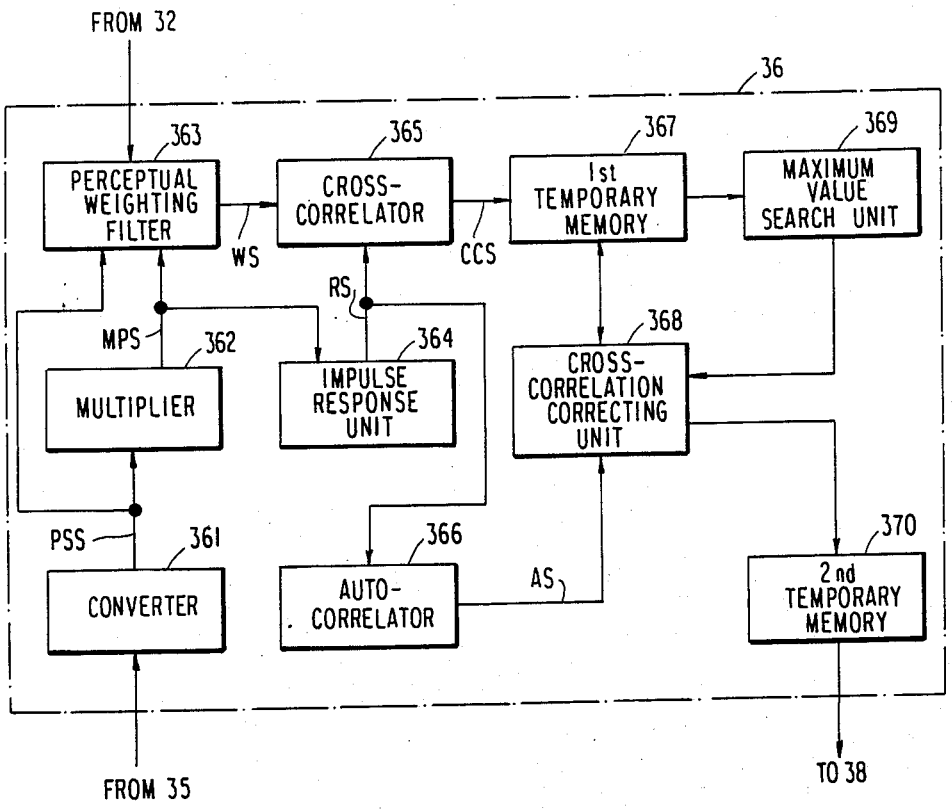
FIG. 3 is a block diagram of a pulse search unit operable as a part of the encoder illustrated in FIG. 2.

Referring to FIG. 3, detail will be described as regards the pulse search unit 36 which is suitable for the encoder according to this invention. The pulse search unit 36 comprises a converter 361 supplied with the decoded k parameter signal from the parameter decoder 35 shown in FIG. 2. In the following, a letter "i" will be used to represent either all of or each of 1 through n. The converter 361 converts the decoded k parameter signal representative of k parameters $k_i$ into an $\alpha$ (parameter signal PSS representative of $\alpha$ parameters $\alpha_i$ related to the k parameters $k_i$ and produces the $\alpha$ parameter signal PSS. The $\alpha$ parameter signal PSS comprises first through n-th $\alpha$ parameters $\alpha_1$ to $\alpha_n$ and is supplied to a multiplier 362 and a perceptual weighting filter 363. The multiplier 362 has first through n-th attenuation coefficients $\gamma'$ to $\gamma^n$, each of which is experimentally determined and has a value between 0 and 1. The multiplier 362 multiplies the $\alpha$ parameter $\alpha_i$ by the attenuation coefficients $\gamma^i$ and produces a multiplied parameter signal MPS representative of multiplied parameters $\alpha_i.\gamma^i$. The multiplied parameter signal MPS is supplied to an impulse response unit 364 and the perceptual weighting filter 363.

The speech signal frame comprises a speech spectrum envelope defined by voiced sound and unvoiced sound and a noise spectrum envelope caused by a quantization noise. The perceptual weighting filter 363 has filter factors based on the $\alpha$ parameters $\alpha_i$ and the multiplied parameters $\alpha_i.\gamma^i$. The perceptual weighting filter 363 processes the speech signal frame so that the quantized noise has the noise spectrum envelope which resembles the speech spectrum envelope. As a result, a perceptual noise is reduced by a masking effect caused by sense of hearing in the manner well known in the art. The perceptual weighting filter 363 delivers a weighted speech signal frame WS to a cross-correlator 365.

Supplied with the multiplied parameter signal MPS, the impulse response unit 364 calculates an impulse response of a synthetic filter having filter factors represented by the multiplied parameters $\alpha_i\gamma^i$ and produces an impulse response signal RS representative of the impulse response. The impulse response signal RS is supplied to an autocorrelator 366 and the cross-correlator 365.

The cross-correlator 365 calculates cross-correlation factor between the weighted speech signal frame WS and the impulse response signal RS and produces a cross-correlation signal CCS representative of the cross-correlation factor. The cross-correlation signal CCS is supplied to a first temporary memory 367. On the other hand, the autocorrelator 366 calculates autocorrelation factor of the impulse response signal RS and produces an autocorrelation signal AS representative of the autocorrelation factor. The autocorrelation signal AS is supplied to a cross-correlation correcting unit 368.

It is known in the art that an x-th excitation pulse has an amplitude $g_x$ and a location $m_x$ given by:

$$g_x(m_x) = \max_{1 \leq m_x \leq N} \left| \frac{\phi_{hs}(m_x) - \sum_{j=1}^{p-1} g_j R_{hh}(|m_j - m_x|)}{R_{hh}(0)} \right|,$$

where $g_j$ and $m_j$ represent the amplitude and the location of an (x−1)-th excitation pulse; $\phi_{hs}$, the cross-correlation factor; $R_{hh}$, the autocorrelation factor; and P, the pulse number of the excitation pulses. Thus, the amplitude $g_x$ and the location $m_x$ can be calculated by the use of the cross-correlation factor $100_{hs}$ between the weighted speech signal frame WS and the impulse response signal RS and by the autocorrelation factor $R_{hh}$ of the impulse response signal RS.

The first temporary memory 367 temporarily memorizes the cross-correlation signal CCS as a stored cross-correlation signal. A maximum value search unit 369 reads the stored cross-correlation signal out of the first temporary memory 367 and searches a maximum value of cross-correlation components of the stored cross-correlation signal. The maximum value search unit 369 delivers the maximum value as a maximum cross-correlation factor $100_{hsl}$ to the cross-correlation correcting unit 368. The cross-correlation correcting unit 368 normalizes the maximum cross-correlation factor $\phi_{hsl}$ by using the autocorrelation factor $R_{hh}(0)$ produced by the autocorrelator 366. The cross-correlation correcting unit 386 delivers a normalized maximum cross-correlation factor as a first excitation pulse of the excitation pulses to a second temporary memory 370 and back to the first temporary memory 367. The first excitation pulse has a first amplitude $g_1$ and a first location $m_1$. The maximum value search unit 369 reads remaining cross-correlation components out of the first temporary memory 367 and searches a next maximum value of the remaining cross-correlation components. The maximum value search unit 369 delivers the next maximum value as a next maximum cross-correlation factor $\phi_{hs2}$ to the cross-correlation correcting unit 368. The cross-correlation correcting unit 368 corrects the next maximum cross-correlation factor $\phi_{hs2}$ by using the first amplitude $g_1$ and the first location $m_1$ read from the first temporary memory 367 and by the autocorrelation factor given by $R_{hh}(|m_1-m_2|)$. Subsequently, the cross-correlation correcting unit 368 normalizes a corrected next maximum cross-correlation factor by using the autocorrelation factor $R_{hh}(0)$ derived from the autocorrelator 366. The ross-correlation correcting unit 368 delivers a normalized next maximum cross-correlation factor as a second excitation pulse of the excitation pulses to the first and the second temporary memories 367 and 370. The second excitation pulse has a second amplitude and a second location. Pulse search operation mentioned above is repeated until the number of the excitation pulses becomes equal to P. Thus, the pulse search unit 36 produces the excitation pulses of P in number in the oreer of the amplitude. It is assumed that the number P is determined at thirty-six.

Referring back to FIG. 2, the excitation pulse group is supplied to a detecting unit 37 and a processing unit 38. The detecting unit 37 is for detecting electric power of the excitation pulse group by using a specific excitation pulse which is included in the excitation pulse group and which has a maximum amplitude. This is because the maximum amplitude of the specific excitation pulse is approximately in proportion to the electric power of the excitation pulse group. The detecting unit 37 comprises a maximum amplitude search unit 371, a maximum amplitude quantizer 372, and a maximum amplitude decoder 373. The maximum amplitude search unit 371 searches the specific excitation pulse of the excitation pulse group and delivers the specific excitation pulse to the maximum amplitude quantizer 372. The maximum amplitude quantizer 372 quantizes the maximum amplitude into a quantized signal QAS depending upon a $\mu$-Law PCM method described in CCITT Recommendation, Vol. III-Rec. G. 777 Tables *2a* and *2b*, pages 375 and 376. According to the $\mu$-Law PCM method, quantization of the amplitude is represented by eight binary bits including a single binary bit representing polarity of the amplitude. By way of example, the maximum amplitude quantizer 372 quantizes the maximum amplitude into a quantized maximum amplitude represented by first through seventh binary bits because it is unnecessary to represent the polarity of the maximum amplitude.

Referring to FIG. 4, the maximum amplitude is variable in an amplitude range between 0 and 8159, both inclusive. The ampliltude range is classified into first through eighth sub-ranges represented by the first through the third binary bits of the quantized signal QAS. For later usage, the first through the eigth sub-ranges will be indicated by eighth coded values of zero through seven, respectively. The first through the eighth sub-ranges cover a plurality of maximum amplitudes, $2^y$ in number, where y represents five through twelve, respectively, in a decreasing order. Thus, the quantized signal QAS represents one of the first through the eighth sub-ranges by the first through the third binary bits. In each sub-range, the maximum amplitudes are quantized by sixteen equal quantization steps and are represented by the fourth through the seventh bits.

For example, the maximum amplitude of the eighth sub-range is represented by the first through the third binary bits, all of which have binary value "1". The fourth through seventh binary bits of the quantized signal QAS represent the maximum amplitudes 0 through 31 according to the sixteen equal quantization steps. It is to be noted here that the electric power level is classified by the reason described before into first through eighth levels corresponding to the first through the eighth sub-ranges, respectively, with lowest electric power level classified in the eighth level and the highest electric power level classified in the first level.

Referring back to FIG. 2, the quantized signal QAS is supplied to a multiplexer 39, the processing unit 38, and the maximum amplitude decoder 373. The maximum amplitude decoder 373 decodes the quantized signal QAS into a decoded maximum amplitude signal and delivers the decoded maximum amplitude signal to the processing unit 38. Supplied with the excitation pulse group, the decoded maximum amplitude signal, and the quantized signal QAS, the processing unit 38, at first, normalizes the excitation pulse group into a normalized excitation pulse group in accordance with the decoded maximum amplitude signal. For this purpose, the processing unit 38 comprises a normalizing unit 381 in addition to a classifying unit 382, an extractor 383, and a pulse quantizer 384. The normalizing unit 381 supplies a normalized excitation pulse group to the extractor 383.

Referring to FIG. 5 together with FIGS. 2 and 4, the classifying unit 382 is supplied with the quantized signal QAS representative of the maximum amplitude and classifies the maximum amplitudes into first through fourth classes shown in FIG. 5. It is to be noted here that the first through the fourth classes are for representing the maximum amplitudes defined by the coded values zero and unity, two and three, four and five, and six and seven, respectively, shown in FIG. 4. For example, the first class means the fact that the maximum amplitude represented by the quantized signal QAS is in the amplitude range between 2015 and 8159, both inclusive, shown in FIG. 4.

In accordance with one of the first through the fourth classes classified by the classifying unit 382, the extractor 383 extracts one of first through fourth pulse numbers of the normalized excitation pulses as extracted excitation pulses from the normalized excitation pulse group. In the example being illustrated, the first through the fourth pulse numbers are equal to twelve, sixteen, twenty-four, and thirty-six, respectively. It is to be noted that the first through the fourth pulse numbers are in inverse proportion to the maximum amplitude, namely, the electric power level described in conjunction with FIG. 4. The extractor 383 delivers the extracted excitation pulses to the pulse quantizer 384.

In accordance with one of the first through the fourth classes classified by the classifying unit 382, the pulse quantizer 384 quantizes the amplitudes of the extracted excitation pulses into a quantized amplitude signal with first bit number given by one of first through fourth amplitude quantization bit numbers. The pulse quantizer 384 also quantizes the locations of the extracted excitation pulses into a quantized location signal with second bit number given by one of first through fourth location quantization bit numbers. As shown in FIG. 5, the first through the fourth amplitude quantization bit numbers are equal to six, four, two, and unity, respectively, and the first through the fourth location quantization bit numbers are equal to six, five, four, and three, respectively. It is to be noted that the first through the fourth amplitude quantization and location quantization bit numbers are in proportion to the maximum amplitude, namely, the electric power level described in conjunction with FIG. 4. Moreover, the first and the second bit numbers are determined so that a product of the pulse number and a sum of the first and the second bit numbers should be kept at a predetermined number independently of the classes. In the example shown in FIG. 5, the predetermined number is equal to 144 and is called a total bit number. In this manner, the quantized amplitude signal and the quantized location signal are transmitted from the pulse quantizer 384 to a multiplexer 39 as a quantized pulse signal at a constant bit rate throughout the speech signal frames.

In FIG. 5, the first bit number is equal to unity when the maximum amplitudes are in the seventh and the eighth sub-ranges of the coded values 6 and 7. In other words, a single binary bit is used to represent the amplitudes of the extracted excitation pulses. In this event, the single bit represents only the polarity oof the extracted excitation pulse. A first reference amplitude $g_m$ is determined for optimum quantization. The first reference amplitude $g_m$ can be obtained by:

$$g_m = \frac{1}{X} \sum_{x=1}^{X} v_x, \tag{1}$$

where X represents the number of the extracted excitation pulses and where $v_x$ represents an absolute value of the amplitude of the extracted excitation pulse. In the fourth class, all of the amplitudes of the extracted excitation pulses are regarded as the first reference amplitude $g_m$.

The first bit number is equal to two when the maximum amplitudes are in the fourth and the fifth sub-ranges of the coded values 4 and 5.

Second and third reference amplitudes $g_z$ and $\frac{1}{2}g_z$ are determined by:

$$\tfrac{1}{2}g_z < g_m < gz < 2g_m.$$

The second reference amplitude $g_z$ is obtained as a value Z given by:

$$Z = \sum_{x=1}^{X} \min \left\{ \begin{array}{l} \left( V_x - \frac{1}{2} g_z \right)^2 \\ (v_x - g_z)^2. \end{array} \right. \quad (2)$$

Practically, the reference amplitude $g_z$ is assumed at first to have four discrete values within an amplitude range $g_m$ through $2_{gm}$. Subsequently, the value Z is calculated according to Equation (2).

Referring back to FIG. 2, the pulse quantizer 384 sends the quantized pulse signal to the multiplexer 39. The multiplexer 39 multiplexes the quantized pulse signal, the quantized signal QAS, and the quantized k parameter signal QS into a multiplexed signal. The multiplexed signal is transmitted through a transmitter (not shown) to the decoder 12 through a transmission line depicted by a dashed line.

In the example being illustrated, the encoder 30 is used at a bit rate of 9600 bit/sec. If the speech signal frame lasts for a time interval of 20 milliseconds and moreover if the quantized pulse signal is represented by 144 bits, the encoder 30 transmits the quantized pulse signal at the bit rate of 7200 bit/sec. In this event, a difference of 2400 bit/sec is used to transmit a frame number of the speech signal frame, the quantized signal QAS, and the quantized k parameter signal QS.

In FIG. 2, the decoder 31 comprises a demultiplexer 40 supplied with the multiplexed signal through the transmission line. The demultiplexer 40 demultiplexes the multiplexed signal into a demultiplexed pulse signal, a demultiplexed maximum amplitude signal, and a demultiplexed k parameter signal. Herein, the demultiplexed pulse signal comprises normalized excitation pulse components as described in conjunction with the normalizing unit 381 (FIG. 2). The demultiplexed pulse signal must be processed by inverse operation relative to the normalization of the normalizing unit 381. For this purpose, the demultiplexed maximum amplitude signal is supplied to an additional maximum amplitude decoder 41 which is similar to the maximum amplitude decoder 373. The additional maximum amplitude decoder 41 therefore decodes the demultiplexed maximum amplitude signal into a decoded signal identical with the decoded maximum amplitude signal produced by the maximum amplitude decoder 373.

The decoded signal is supplied to a decoding unit 42. The decoding unit 42 comprises a recovering unit 421 and a pulse decoder 422. Supplied with the demultiplexed pulse signal and the decoded signal, the recovering unit 421 carries out inverse operation relative to the normalization of the normalizing unit 381 on the decoded signal. The recovering unit 421 supplies a recovered pulse signal to the pulse decoder 422. The pulse decoder 422 decodes the recovered pulse signal into a decoded pulse signal and delivers the decoded pulse signal to an LPC synthetic filter 43.

On the other hand, a k parameter decoder 44 decodes the demultiplexed k parameter signal into a decoded k parameter signal and delivers the decoded k parameter signal to the LPC synthetic filter 43. The LPC synthetic filter 43 comprises an all-pole type digital filter and synthesizes the decoded pulse signal and the decoded k parameter signal into a digital synthetic signal in the manner known in the art. The digital synthetic signal is supplied to a digital-to-analog converter 45 comprising a low-pass filter (not shown). The digital-to-analog converter 45 converts the digital synthetic signal into an analog synthetic signal and produces a filtered analog synthetic signal as a synthetic speech signal through the low-pass filter.

While this invention has thus far been described in conjunction with a few preferred embodiments thereof, it will readily be possible for those skilled in the art to put this invention into practice in various other manners. For example, it is possible to change the pulse number, the first and the second bit numbers, and the classes thereof. The maximum amplitude quantizer 372 may be implemented by another type quantizer. The quantized pulse signal and the parameter signal may be once memorized in a memory and then supplied to a decoder.

What is claimed is:

1. An encoder for use in encoding a speech signal into an encoded signal, said speech signal being divided into a succession of frames, said encoder including pulse producing means responsive to said speech signal for producing an excitation pulse sequence including a plurality of excitation pulses in each of said frames, wherein the improvement comprises:

detecting means responsive to said speech signal for detecting electric power of said speech signal to produce a detection signal representative of said electric power by one of a plurality of levels for each of said frames; and processing means coupled to said pulse producing means and said detecting means for processing said excitation pulse sequence in accordance with said detection signal to produce a processed signal as said encoded signal.

2. An encoder as claimed in claim 1, wherein said processing means comprises:

classifying means coupled to said detecting means for classifying said detection signal into a plurality of classes in accordance with said levels;

extracting means coupled to said pulse producing means and said classifying means for extracting an extracted pulse sequence from said excitation pulse sequence in accordance with said classes, said extracted pulse sequence including extracted pulses of a pulse number determined discretely in inverse proportion to one of said levels that said detection signal has in each of said frames, said extracted pulses having amplitudes and locations; and quantizing means coupled to said classifying means and said extracting means for quantizing the amplitudes and the locations of the extracted pulses of said pulse number into quantized amplitudes and quantized locations to make said processed signal represent said quantized amplitudes and locations, each of said quantized amplitudes and each of said quantized locations being represented by bits of a first and a second bit number, respectively, said first and said second bit numbers being determined discretely in proportion to said one of the levels with a product of said pulse number and a sum of said first and said second bit numbers kept at a predetermined number.

3. An encoder for use in encoding a speech signal into an encoded signal, said speech signal being divided into a succession of frames, said encoder including pulse producing means responsive to said speech signal for producing an excitation pulse sequence including a plurality of excitation pulses in each of said frames, wherein the improvement comprises:

detecting eans responsive to said excitation pulse sequence for detecting electric power of said excitation pulse sequence to produce a detection signal representative of said electric power by one of a plurality of levels for each of said frames; and processing means coupled to said pulse producing means and said detecting means for processing said excitation pulse sequence in accordance with said detection signal to produce a processed signal as said encoded signal.

4. An encoder as claimed in claim 3, wherein said detecting means comprises:

searching means responsive to said excitation pulse sequence for searching in said excitation pulse sequence a specific excitation pulse having a maximum amplitude in each of said frames to produce said specific excitation pulse; and pulse quantizing means coupled to said searching means for quantizing the maximum amplitude of said specific excitation pulse into a quantized amplitude with reference to a plurality of quantization steps to make sad one of the levels represent said quantized amplitude, said quantization steps being narrower and wider when said levels are low and high, respectively.

5. An encoder as claimed in claim 3, wherein said processing means comprises:

classifying means coupled to said detecting means for classifying said detection signal into a plurality of classes in accordance with said levels;

extracting means coupled to said pulse producing means and said classifying means for extracting an extracted pulse sequence from said excitation pulse sequence in accordance with said classes, said extracted pulse sequence including extracted pulses of a pulse number determined discretely in inverse proportion to one of said levels that said detection signal has in each of said frames, said extracted pulses having amplitudes and locations; and quantizing means coupled to said classifying means and said extracting means for quantizing the amplitudes and the locations of the extracted pulses of said pulse number into quantized amplitudes and quantized locations to make said processed signal represent said quantized amplitudes and locations, each of said quantized amplitudes and each of said quantized locations being represented by bits of a first and a second bit number, respectively, said first and said second bit numbers being determined discretely in proportion to said one of the levels with a product of said pulse number and a sum of said first and said second bit numbers kept at a predetermined number.

* * * * *

UNITED STATES PATENT AND TRADEMARK OFFICE

CERTIFICATE OF CORRECTION

PATENT NO. : 4,881,267

DATED : November 14, 1989

INVENTOR(S) : Tetsu Taguchi

It is certified that error appears in the above-identified patent and that said Letters Patent is hereby corrected as shown below:

Column 5, line 63, delete "$100_{hs}$", and insert --$\phi_{hs}$--.

Column 6, line 7, delete "$100_{hsi}$", and insert --$\phi_{hsi}$--.

Column 6, line 32, delete "ross", and insert --cross--.

Column 6, line 42, delete "oreer", and insert --order--.

Column 8, line 44, delete "oof", and insert --of--.

Column 11, line 3, delete "eans", and insert --means--.

Column 11, line 25, delete "sad", and insert --said--.

Signed and Sealed this

Nineteenth Day of March, 1991

*Attest:*

HARRY F. MANBECK, JR.

*Attesting Officer*

*Commissioner of Patents and Trademarks*